US005658429A

United States Patent [19]

Andersson et al.

[11] Patent Number: 5,658,429

[45] Date of Patent: Aug. 19, 1997

[54] PROCESS FOR BLEACHING OF LIGNOCELLULOSE-CONTAINING PULP USING A CHELATING AGENT PRIOR TO A PEROXIDE-OZONE-PEROXIDE SEQUENCE

[75] Inventors: Lennart Andersson, Göteborg; Jiri Basta, Partille; Lillemor Holtinger, Nödinge; Jan Höök, Lilla Edet, all of Sweden

[73] Assignee: Eka Nobel AB, Bohus, Sweden

[21] Appl. No.: 307,110

[22] Filed: Sep. 16, 1994

Related U.S. Application Data

[63] Continuation of Ser. No. 40,570, Mar. 31, 1993, abandoned, which is a continuation of Ser. No. 875,680, Apr. 28, 1992, abandoned.

[30] Foreign Application Priority Data

Apr. 30, 1991 [SE] Sweden ..... 9101300

[51] Int. Cl.[6] ..... D21C 9/153; D21C 9/16

[52] U.S. Cl. ..... 162/65; 162/76; 162/78

[58] Field of Search ..... 162/76, 82, 78, 162/65

[56] References Cited

U.S. PATENT DOCUMENTS

| | | | |
|---|---|---|---|
| 2,466,633 | 4/1949 | Brabender et al. . | |
| 3,663,357 | 5/1972 | Liebergott | 162/65 |
| 4,196,043 | 4/1980 | Singh | 162/78 |
| 4,372,812 | 2/1983 | Phillips et al. | 162/65 |
| 4,450,044 | 5/1984 | Fritzvold et al. | 162/65 |
| 4,459,174 | 7/1984 | Papageorges et al. | 162/78 |
| 4,812,206 | 3/1989 | Devic et al. | 162/78 |
| 4,938,842 | 7/1990 | Whiting et al. | 162/78 |
| 4,959,124 | 9/1990 | Tsai | 162/65 |
| 5,143,580 | 9/1992 | Basta et al. | 162/78 |
| 5,164,044 | 11/1992 | Griggs et al. | 162/78 |
| 5,166,044 | 11/1992 | Griggs et al. | 162/65 |

FOREIGN PATENT DOCUMENTS

| | | | |
|---|---|---|---|
| 1119360 | 9/1982 | Canada . | |
| 1132760 | 10/1982 | Canada . | |
| 0402335 | 12/1990 | European Pat. Off. | 162/78 |
| 0285530 | 1/1993 | European Pat. Off. . | |
| 54-55607 | 5/1979 | Japan | 162/65 |
| 57-053916 | 11/1982 | Japan . | |
| 1266293 | 10/1989 | Japan . | |
| WO91/18145 | 11/1991 | WIPO . | |

OTHER PUBLICATIONS

Ruhanen et al, "First–Stage Bleaching of Softwood Kraft Pulp with Peroxide, Instead of Chlorine"; *Tappi Journal*, Sep. 1982 pp. 107–110.

Gellerstedt et al, "Chem Aspets of $H_2O_2$ Bleaching, Part II"; Marcel Dekker, Inc. 1982 .

Soteland, "Bleaching of Chemical Pulps With Oxygen and Ozone", *Pulp & Paper Mag. of Canada*, Apr. 1974, pp. 91–96.

R. W. Allison, International Pulp Bleaching Conference, "Effects of Temperature and Chemical Pretreatment on Pulp Bleaching with Ozone", pp. 47–52 (1986).

D.L.–K. Wang et al, Das Papier, 38 (1984), No. 6, pp. 245–254, Delignification of Spruce and Beach Sulphite Pulp by Means of Ozone (English Abstract), Abstract.

R. Patt et al, Das Papier, 42 (1988), No. 10A, pp. v14–V23, Application of Ozone in Cellulose Bleaching (English abstract), Abstract.

"Keys to Chelation", The Dow Chemical Company, 1985.

"Effect of pulp consistency and pH in ozone bleaching", Carl–Anders Lindholm, 1987.

"Use of Ozone for pulp bleaching", R. Patt et al, Institute of Paper Chemistry.

"Effects of Temperature and Chemical Pretreatment on Pulp Bleaching with Ozone".

Germgård et al, Svensk Papperstidning, 88(15), R127–132 (1985), "Ozone Prebleaching of Modified–Cooked and Oxygen–Bleached Softwood Kraft Pulp".

*Primary Examiner*—Steven Alvo
*Attorney, Agent, or Firm*—Leydig, Voit & Mayer

[57] ABSTRACT

A process for delignification and bleaching of chemically digested lignocellulose-containing pulp, where the pulp is treated with a complexing agent at a pH between 3.1 and 9.0, whereupon the pulp is bleached with ozone. The initial treatment with a complexing agent removes the ions of certain metals detrimental to the subsequent ozone bleaching, while retaining in the pulp the desirable ions, primarily of alkaline earth metals. Thereby, the selectivity in the delignification is increased and the strength of the pulp maintained. The pulp can be bleached with peroxide before the ozone step and/or after the treatment according to the invention, to obtain the desired final brightness and completely avoid formation and discharge of chlorinated organic compounds.

12 Claims, No Drawings

PROCESS FOR BLEACHING OF LIGNOCELLULOSE-CONTAINING PULP USING A CHELATING AGENT PRIOR TO A PEROXIDE-OZONE-PEROXIDE SEQUENCE

This application is a continuation of application Ser. No. 08/040,570, filed Mar. 31, 1993, now abandoned, in turn a continuation of application Ser. No. 07/875,680, filed Apr. 28, 1992, and now abandoned.

The present invention relates to a process for delignification and bleaching of chemically digested lignocellulose-containing pulp, where the pulp is treated with a complexing agent at a pH between 3.1 and 9.0, whereupon the pulp is bleached with ozone. The initial treatment with a complexing agent removes the ions of certain metals detrimental to the subsequent ozone bleaching while retaining in the pulp the desirable ions, primarily of alkaline earth metals. Thereby, the selectivity in the delignification is increased. The pulp can be bleached with peroxide before the ozone step and/or after the treatment according to the invention, to obtain the desired final brightness and completely avoid formation and discharge of chlorinated organic compounds.

BACKGROUND

In the production of chemical pulp of high brightness, wood chips are first cooked to separate the cellulose fibres. Part of the lignin holding the fibres together is thus degraded and modified, such that it can be removed by subsequent washing. However, in order to obtain sufficient brightness, more lignin has to be removed, together with brightness-impairing (chromophoric) groups. This is frequently effected by delignification with oxygen, followed by bleaching in several stages.

For environmental reasons, it has become increasingly common to treat chemical pulp with chlorine-free bleaching agents as early as in the first bleaching steps, thereby drastically reducing the discharges of chlorinated organic compounds detrimental to the environment. Ozone is a very suitable bleaching agent from an environmental point of view. Furthermore, ozone is very effective when attacking the lignin but also when attacking the cellulose chains in the pulp. Thus, the pulp obtained has an extremely high brightness with but a small charge of ozone, but the inadequate selectivity in the delignification brings about a pulp of insufficient strength.

It is known to use chlorine-free bleaching agents, such as hydrogen peroxide and ozone, as early as in the prebleaching. However, the delignification and the consumption of the bleaching agent become less effective than with chlorine-containing bleaching agents, unless the pulp is pretreated. Thus, an ozone treatment is disturbed by the presence in the pulp of ions of certain metals, such as Mn, Cu and Fe. These metal ions cause disintegration of the ozone and/or degradation products, which tend to considerably reduce the strength properties of the pulp, such as the viscosity. This can be counteracted by pretreating the pulp at a low pH by means of a so-called acid wash, e.g. according to Germgård et al, Svensk Papperstidning, 88(15), R127–132 (1985). The pulp may also be treated at a low pH directly in the first step of the bleaching sequence, by bleaching with chlorine-containing chemicals, such as chlorine dioxide, e.g. according to U.S. Pat. No. 4,959,124. Such treatment reduces the concentrations of all types of metal ions.

THE INVENTION

The invention provides a process in which lignocellulose-containing pulp is treated under the conditions disclosed in the claims, whereby the initial treatment with a complexing agent effectively removes the metal ions detrimental to the subsequent ozone bleaching, while retaining in the pulp the desirable metal ions. By this process, the lignin in the pulp is attacked more selectively in the subsequent ozone bleaching.

The invention concerns a process for bleaching chemically digested lignocellulose-containing pulp in order to render more effective a bleaching sequence with ozone, altering the trace-metal profile of the pulp by treatment with a complexing agent at a pH in the range from 3.1 up to 9.0, whereupon the pulp is bleached with ozone.

The main difference between prior-art ozone techniques and the invention is that the present process makes possible a maintained pulp strength, e.g. measured as viscosity, while a high degree of brightness is obtained. It has thus been found that the treatment with a complexing agent at an almost neutral pH instead of a highly acidic treatment with acid wash or chlorine-containing bleaching steps, entails that certain desirable ions in the pulp are maintained, both as to concentration and position. These ions, primarily of alkaline earth metals, such as magnesium and calcium, slow down the attack by ozone and its degradation products on the cellulose chains in particular. Thus, the selectivity in the delignification is increased and the shortening of the cellulose chains is counteracted, the latter giving a strong pulp. Despite the slowing-down of the ozone attack, use of the present process means a rapid bleaching course, since the ozone in itself is one of the most energetic bleaching chemicals hitherto known.

In the process according to the invention, the treatment with a complexing agent is carried out at a pH of from 3.1 up to 9.0, suitably from 4 up to 8, preferably from 5 up to 7. The ozone bleaching is carried out at a pH in the range from about 1 up to about 8, suitably in the range from 1 up to 4.

In a process according to the invention where the initial bleaching with ozone is followed by a bleaching step with a peroxide-containing compound, the pH suitably is kept in the range from 5 up to 7 in the treatment with a complexing agent. In the bleaching with ozone the pH is suitably retained within the range from 5 up to 7, to maintain the optimal trace-metal profile for the subsequent treatment with a peroxide-containing compound. The treatment with a peroxide-containing compound, suitably takes place within the range from 8 up to 12.

The treatment according to the invention, is preferably carried out with a bleaching step with a peroxide-containing compound before the ozone bleaching of the pulp. It has been found that the detrimental effect of the ozone on the viscosity of the pulp, is considerably reduced if the ozone step is preceded by a peroxide step. In addition, the brightness of the pulp is further improved.

Peroxide-containing compounds relate to inorganic peroxide compounds, such as hydrogen peroxide and sodium peroxide, and organic peroxide compounds, such as peracetic acid, separately or in optional mixtures. The effect of the peroxide-containing compound may also be reinforced by the presence of oxygen. Preferably, use is made of hydrogen peroxide or a mixture of hydrogen peroxide and oxygen.

If the peroxide-containing compound is hydrogen peroxide, the pulp is suitably bleached at a pH of from about 8 up to about 12, preferably at a pH of from 10 up to 12. Treatment with the other peroxide-containing compounds mentioned above, is carried out within the normal pH range for each bleaching agent, which are well-known to the person skilled in the art.

The complexing agent used is primarily chosen from nitrogenous polycarboxylic acids, suitably diethylenetriaminepentaacetic acid (DTPA), ethylenediaminetetraacetic acid (EDTA) or nitrilotriacetic acid (NTA), preferably DTPA or EDTA, polycarboxylic acids, suitably oxalic acid, citric acid or tartaric acid, or phosphonic acids, suitably diethylenetriaminepentaphosphonic acid.

The treatment according to the invention is preferably carried out with a washing step after the treatment with a complexing agent, such that the non-desirable complexed ions of certain metals are removed as completely as possible from the pulp suspension prior to the treatment with ozone or, optionally, a peroxide-containing compound.

After the treatment according to the invention, the pulp can be dewatered and the spent liquor be recycled in order to lower the pulp concentration before the ozone step. Also, the pulp can be washed with water after the ozone step, and this washing water can also be recycled a position before the ozone step.

The treatment with a complexing agent and ozone can be carried out either immediately after digestion of the pulp or after an oxygen step. The process according to the invention is preferably applied to pulp that has been delignified in an oxygen step prior to the treatment.

Lignocellulose-containing pulps relate to chemical pulps of softwood and/or hardwood digested according to the sulphite, sulphate, soda or organosolv process, or modifications and/or combinations thereof. Use is suitably made of softwood and/or hardwood digested according to the sulphate process, preferably sulphate pulp of hardwood.

The treatment according to the invention can be applied to lignocellulose-containing pulps having an initial kappa number within the range from about 5 up to about 40, suitably from 7 up to 32, preferably from 10 up to 20. Here, the kappa number is determined according to the standard method SCAN-C 1:77.

The amount of complexing agent (100% product) charged, lies in the range from about 0.1 up to about 10 kg/ton of dry pulp, suitably in the range from 0.5 up to 5 kg/ton of dry pulp and preferably in the range from 1 up to 2.5 kg/ton of dry pulp.

The amount of ozone charged, lies in the range from about 0.1 up to about 20 kg/ton of dry pulp, suitably in the range from 0.5 up to 10 kg/ton of dry pulp and preferably in the range from 2 up to 10 kg/ton of dry pulp. If ozone is the initial bleaching agent, very good results are obtained with ozone charges within the range from 3 up to 6 kg/ton of dry pulp.

In preferred embodiments employing hydrogen peroxide as the peroxide-containing compound before the ozone step, the amount of hydrogen peroxide, lies in the range from about 0.5 up to about 50 kg/ton of dry pulp, calculated as 100% hydrogen peroxide. The upper limit is not critical, but has been set for reasons of economy. The amount of hydrogen peroxide suitably lies in the range from about 2 up to about 50 kg/ton of dry pulp and preferably from 3 up to 35 kg/ton of dry pulp, calculated as 100% hydrogen peroxide. It is especially preferred with an amount of hydrogen peroxide within the range from 4 up to 25 kg/ton of dry pulp, calculated as 100% hydrogen peroxide. Hydrogen peroxide can also be used after the ozone step, at which the charges of hydrogen peroxide in both steps are adapted to give the desired brightness of the pulp.

In the process according to the invention, the treatment with a complexing agent is carried out at a temperature of from about 10° up to about 100° C., suitably from 26° up to 95° C., preferably from 40° up to 90° C., and for a period of time of from about 1 up to about 360 min, preferably from 5 up to 60 min. The ozone bleaching is carried out at a temperature of from about 10° up to about 100° C., preferably from 25° up to 90° C., and for a total residence time of from about 1 up to about 120 min, preferably from 10 up to 60 min. The time of contact between ozone and the pulp influences the brightness as well as viscosity and is among other things dependent on the pulp concentration. Thus, a contact time of from about 1 up to about 2 min is suitable at a pulp concentration of about 35 percent by weight. The contact time is suitably from about 10 up to about 30 seconds at a pulp concentration of about 10 percent by weight. In the treatment with a complexing agent and in the ozone bleaching, the pulp concentration may be from about 1 up to about 40% by weight, suitably from 3 up to 35% by weight, preferably from 5 up to 15% by weight.

In the treatment with a complexing agent and the ozone bleaching, the pH value can be adjusted by means of sulphuric acid or residual acid from a chlorine dioxide reactor. In the ozone bleaching, the pH value can also be adjusted by recycling acidic spent bleach liquor from the ozone step. In the peroxide treatment in alkaline environment, the pH is suitably adjusted by adding, to the pulp, an alkali or an alkali-containing liquid, e.g. sodium carbonate, sodium hydrogen carbonate, sodium hydroxide, oxidized white liquor or magnesium hydroxide slurry. Suitably, the magnesium hydroxide slurry is taken from the. chemical handling system in the production of sulphite pulp with magnesium as base, so-called magnetite pulp.

In bleaching with hydrogen peroxide as the peroxide-containing compound before and/or after the ozone step, the pulp is bleached at a temperature of from about 30° up to about 100° C., preferably from 60° up to 90° C., and for a period of time of from about 30 up to about 300 min, suitably from 60 up to 240 min. The pulp concentration may be from about 3 up to about 35% by weight, preferably from 10 up to 25% by weight. Treatment with the other peroxide-containing compounds mentioned above, is carried out within the normal ranges of temperature, time and pulp concentration for each bleaching agent, which are well-known to the person skilled in the art.

After the treatment with a complexing agent and bleaching with ozone, the pulp can be used for direct production of paper with a lower demand of brightness. Alternatively, the pulp may be finally bleached to the desired higher brightness, by treatment in one or more steps. Suitably, the final bleaching is carried out with chlorine-free bleaching and extraction agents, such as the above-mentioned peroxide-containing compounds, ozone or oxygen. In this way, the formation and discharge of chlorinated organic compounds are completely eliminated. Suitably, the final bleaching is carried out with a peroxide-containing compound in alkaline solution in one or more steps, optionally reinforced with oxygen. By the treatment according to the invention, the lignin content has been reduced to a sufficiently low level before any chlorine-containing bleaching agents are used. Therefore, chlorine dioxide and/or hypochlorite may well be used in one or more final bleaching steps without causing formation of large amounts of chlorinated organic compounds.

In a bleaching process for chemical pulps, the aim is a high brightness, a low kappa number and a sufficiently high viscosity, the latter meaning that the strength of the pulp will correspond to the demands of the market. When use is made of the process according to the invention, the strength of the pulp, measured as viscosity, is higher than in prior-art techniques for ozone bleaching. This means that the pulp contains such long cellulose chains, that a sufficiently strong product can be obtained. Furthermore, the resulting pulp has a higher brightness and a lower kappa number, than pulp from processes in which the trace-metal profile has not been adjusted before the ozone treatment or at a pH outside the range of the present process. Thus, as is apparent from Example 3, use of the present process in the sequence Step1-$P_1$-Z-$P_2$ makes it possible to obtain a sulphate pulp of hardwood with a final brightness of more than 89% ISO at a viscosity exceeding 800 $dm^3$/kg. Here, only chlorine-free bleaching agents has been used in each bleaching step, which means that this process is superior to prior-art bleaching techniques from an environmental point of view.

The invention and its advantages are illustrated in more detail by the Examples below which, however, are only intended to illustrate the invention and are not intended to limit the same. The kappa number, viscosity and brightness of the pulp were determined according to SCAN standard methods. The percentages and parts stated in the description, claims and examples, refer to percent by weight and parts by weight, respectively, unless anything else is stated.

EXAMPLE 1

Oxygen-delignified sulphate pulp of birchwood having a kappa number of 13.0, a brightness of 47.1% ISO and a viscosity of 1120 $dm^3$/kg was treated according to the invention in the sequence Step1-Z, in which Step1 represents a complexing agent and Z represents ozone ($O_3$). In the treatment with a complexing agent, 2 kg EDTA/ton of dry pulp was charged, the temperature was 70° C., the pH was 6, the residence time was 60 min, and the pulp concentration was 10% by weight. After washing, the pulp was treated with 3 and 6 kg ozone/ton of dry pulp, respectively, at a pH of 2.0, a temperature of 25° C., the pulp concentration being 30% by weight. The total residence time, including subsequent washing, was 30 min in the treatment with ozone. The contact time between ozone and the pulp was about 1 min. For comparative purposes, the same pulp was treated in accordance with prior-art techniques in the sequence (Acid wash)-Z, in which (Acid wash) represents treatment of the pulp at a pH of about 1.5 without any addition of a complexing agent. The results after the ozone step appear from the Table below.

TABLE I

| Amount of $O_3$ | Prior art technique | | | Process according to the invention | | |
|---|---|---|---|---|---|---|
| charged (kg/ton) | Kappa No | Visc. ($dm^3$/kg) | Brightn. (% ISO) | Kappa No | Visc. ($dm^3$/kg) | Brightness (% ISO) |
| 3 | 8.5 | 950 | 54.8 | 8.1 | 1050 | 57.9 |
| 6 | 6.9 | 820 | 57.5 | 5.1 | 920 | 62.5 |

As is apparent from the Table, the treatment according to the invention employing a complexing agent before the ozone step gives a lower reduction in viscosity, a higher increase in brightness, and a larger reduction in the kappa number than when use is made of prior-art pretreatment techniques.

EXAMPLE 2

Oxygen-delignified sulphate pulp of pinewood having a kappa number of 16.8, a brightness of 33.5% ISO, and a viscosity of 1050 $dm^3$/kg was treated according to the invention in the sequence Step1-$P_1$-Z, in which $P_1$ represents hydrogen peroxide. The conditions in Step1 and Z corresponded to those of Example 1, except that the amount of ozone charged was 5 kg/ton of dry pulp in the Z step. The pulp was washed after Step1, whereupon it was bleached in step $P_1$ with 15 kg hydrogen peroxide/ton of dry pulp at a pH of 11.0, a temperature of 90° C. and for 240 min, the pulp concentration being 10% by weight. For comparative purposes, the same pulp was treated according to prior-art techniques in the sequence (Acid wash)-$P_1$-Z, in which (Acid wash) represents treatment under the conditions given in Example 1. The conditions in $P_1$ and Z corresponded to those stated above, and the amount of ozone charged was 5 kg/ton of dry. pulp. The results after each step appear from the Table.

TABLE II

| Bleaching step | Prior art technique | | | Process according to the invention | | |
|---|---|---|---|---|---|---|
| | Kappa No | Visc. ($dm^3$/kg) | Brightn. (% ISO) | Kappa No | Visc. ($dm^3$/kg) | Brightness (% ISO) |
| $P_1$ | 9.0 | 910 | 58.1 | 8.7 | 960 | 64.0 |
| Z | 2.7 | 730 | 67.5 | 2.0 | 600 | 73.1 |

As is apparent from the Table, the preferred embodiment of the present invention involving peroxide bleaching after the treatment with a complexing agent, means a much lower reduction in viscosity than when use is made of prior-art techniques.

EXAMPLE 3

The oxygen-delignified sulphate pulp of birchwood employed in Example 1 was treated according to the invention in the sequence Step1-$P_1$-Z-$P_2$, in which $P_2$ represents final bleaching with hydrogen peroxide. The conditions in Step1 and Z, and $P_1$ corresponded to those of Examples 1 and 2, respectively, except that the amount of ozone charged in Z was 5 kg/ton of dry pulp and the amount of hydrogen peroxide ($H_2O_2$) charged in $P_1$ was varied between 15 and 30 kg/ton of dry pulp. The pulp was finally bleached ($P_2$) with 5 kg hydrogen peroxide/ton of dry pulp at a pH of 10.8, a temperature of 60° C. and for 75 min, the pulp concentration being 10% by weight. The results after each step appear from the Table below.

TABLE III

| Amount of $H_2O_2$ charged in $P_1$ (kg/ton of pulp) | Step | Kappa No. | Viscosity ($dm^3$/kg) | Brightness (% ISO) |
|---|---|---|---|---|
| 15 | $P_1$ | 8.5 | 1010 | 76.0 |
| | Z | 3.3 | 885 | 82.3 |
| | $P_2$ | 1.4 | 900 | 86.0 |
| 20 | $P_1$ | 7.9 | 995 | 79.4 |
| | Z | 3.1 | 870 | 84.6 |
| | $P_2$ | 1.3 | 890 | 87.6 |
| 30 | $P_1$ | 7.7 | 955 | 82.2 |
| | Z | 2.8 | 850 | 86.0 |
| | $P_2$ | 1.1 | 850 | 89.1 |

As is apparent from the Table, a sulphate pulp of birchwood can be finally bleached to full brightness by a charge of hydrogen peroxide of 30 kg/ton of dry pulp in the $P_1$ step. This is possible, while at the same time diminishing the viscosity reduction normally obtained in bleaching steps involving ozone and eliminating the viscosity reduction normally obtained in final bleaching steps involving hydrogen peroxide.

EXAMPLE 4

Oxygen-delignified sulphate pulp of softwood having a kappa number of 14.0, a brightness of 37% ISO and a viscosity of 1040 $dm^3/kg$ was treated according to the invention in the sequences Step1-Z-$P_1$, Step1-$P_1$-Z and Step1-$P_1$-Z-$P_2$. In the treatment with a complexing agent (Step1), 2 kg EDTA/ton of dry pulp was charged, at a temperature of 60° C., a pH of about 6, a pulp concentration of 10% by weight and a residence time of 30 min. In the ozone step (Z) 3.5 kg of ozone/ton of dry pulp was charged, at a temperature of 25° C., a pH of about 2, a pulp concentration of about 35% by weight and a contact time between ozone and the pulp of about 1 min. In the first step with hydrogen peroxide ($P_1$), 20 kg of hydrogen peroxide/ton of dry pulp was charged at a temperature of 90° C., a pH of 11, a pulp concentration of 10% by weight and a residence time of 240 min. In the second step with hydrogen peroxide ($P_2$), 5 kg of hydrogen peroxide/ton of dry pulp was charged at a temperature of 70° C., a pH of 11, a pulp concentration of 10% by weight and a residence time of 60 min. For comparative purposes, the same pulp was also treated in the sequence Step1-Z-$P_1$ without using EDTA in Step1, to show the influence of a complexing agent before the ozone step. The results after each sequence appear from the Table below.

TABLE IV

| Sequence | pH in Step1 | Kappa No. | Viscosity ($dm^3/kg$) | Brightness (% ISO) |
|---|---|---|---|---|
| Step1-P | 6.2 | 7.4 | 932 | 71.6 |
| Step1-Z-P | 2.0 | 5.8 | 811 | 60.5 |
| Step1-Z-P | 4.8 | 4.8 | 814 | 73.3 |
| Step1-P-Z | 6.2 | 3.9 | 801 | 77.3 |
| Step1-P-Z-P | 6.2 | 1.7 | 828 | 82.1 |
| Step1-Z-P* | 5.7 | 6.9 | 743 | 53.1 |

*No EDTA-added

As is apparent from the Table, a treatment of the pulp with a complexing agent and ozone according to the present process in sequences where hydrogen peroxide is used before and/or after the ozone step, gives very good results as regards kappa number, viscosity and brightness.

We claim:

1. A process for delignifying and bleaching chemically digested lignocellulose-containing pulp, comprising the steps of (a) treating the pulp with a complexing agent at a pH in the range from 3.1 up to 9.0, thereby altering the trace metal profile of the pulp, (b) washing the pulp to remove non-desirable complexed metal ions, (c) bleaching the pulp with a peroxide-containing compound at a pH in the range from about 8 up to about 12, (d) bleaching the pulp from step (c) with ozone, and (e) finally bleaching the pulp with a peroxide-containing compound in alkaline solution, wherein the amount of complexing agent in step (a) is sufficient to maintain a high pulp viscosity by reducing the degradation of cellulose fibers in said pulp by ozone in step (d).

2. A process according to claim 1, wherein the treatment with a complexing agent in step (a) is carried out at a pH in the range from 4 up to 8.

3. A process according to claim 2, wherein the treatment with a complexing agent in step (a) is carried out at a pH in the range from 5 up to 7.

4. A process according to claim 1, wherein the complexing agent comprises at least one nitrogenous polycarboxylic acid.

5. A process according to claim 1, wherein the peroxide-containing compound of bleaching step (c) is hydrogen peroxide or a mixture of hydrogen peroxide and oxygen.

6. A process according to claim 5, wherein the bleaching with a peroxide-containing compound in step (c) is carried out at a pH in the range of from 10 up to 12.

7. A process according to claim 1, wherein the pulp is a sulphate pulp.

8. A process according to claim 7, wherein the sulfate pulp is hardwood.

9. A process according to claim 1, wherein the amount of ozone in bleaching step (d) is from about 0.1 up to about 20 kg/ton.

10. A process according to claim 9, wherein the amount of ozone in bleaching step (d) is from about 0.5 to about 10 kg/ton of dry pulp.

11. A process according to claim 1, wherein the ozone bleaching in step (d) is carried out at a pH in the range from about 1 up to about 8.

12. A process according to claim 11, wherein the pH of the ozone bleaching step (d) is from about 1 to about 4.

* * * * *